US008366506B2

(12) United States Patent
Hwang et al.

(10) Patent No.: US 8,366,506 B2
(45) Date of Patent: Feb. 5, 2013

(54) REMOTE-CONTROLLED FLUTTERING OBJECT CAPABLE OF FLYING FORWARD IN UPRIGHT POSITION

(75) Inventors: Hee Chul Hwang, Gyeonggi-do (KR); Il Hyun Paik, Seoul (KR); Jae Yeon Kim, Seoul (KR)

(73) Assignee: Hanwha Corporation, Seoul (KR)

( * ) Notice: Subject to any disclaimer, the term of this patent is extended or adjusted under 35 U.S.C. 154(b) by 356 days.

(21) Appl. No.: 12/812,456

(22) PCT Filed: Jan. 11, 2008

(86) PCT No.: PCT/KR2008/000183

§ 371 (c)(1),
(2), (4) Date: Jul. 14, 2010

(87) PCT Pub. No.: WO2009/088113

PCT Pub. Date: Jul. 16, 2009

(65) Prior Publication Data

US 2010/0288871 A1 Nov. 18, 2010

(51) Int. Cl.
*A63H 27/28* (2006.01)
*A63H 27/00* (2006.01)

(52) U.S. Cl. ..... 446/35; 446/454; 244/11

(58) Field of Classification Search ..... 446/34, 446/35, 36, 37, 61, 62, 454, 456; 244/11, 244/72

See application file for complete search history.

(56) References Cited

U.S. PATENT DOCUMENTS 6,550,716 B1 * 4/2003 Kim et al. ..... 244/11
6,632,119 B2 * 10/2003 Chernek et al. ..... 446/35
6,659,395 B2 * 12/2003 Rehkemper et al. ..... 244/17.11
6,659,397 B1 * 12/2003 Charron ..... 244/72
6,751,529 B1 6/2004 Fouche
7,946,526 B2 * 5/2011 Zimet ..... 244/17.19
2007/0105475 A1 * 5/2007 Gotou et al. ..... 446/37
2007/0262194 A1 11/2007 Agrawal

FOREIGN PATENT DOCUMENTS

JP 2005-119658 5/2005
KR 2003-0044625 6/2003
KR 10-2004-0056891 7/2004

(Continued)

OTHER PUBLICATIONS

International Search Report of International Application PCT/KR2009/000183 mailed Oct. 8, 2008.
English Abstract of JP 2005-119658.
English Abstract of KR 10-0515031.
English Abstract of KR 10-2004-0056891.

(Continued)

*Primary Examiner* — Kien Nguyen
(74) *Attorney, Agent, or Firm* — Rabin & Berdo, P.C.

(57) ABSTRACT

The present invention provides a remote-controlled ornithopter capable of flying forward in the upright position, which includes X-shaped main wings? having opposite phases to offset moments applied to a fuselage of the ornithopter. The ornithopter includes the fuselage (100), the X-shaped main wings (200), which are provided on the front end of the fuselage, tail wings (300), which are provided on the medial portion or the rear end of the fuselage, and a tail rotor (400), which controls a direction in which the fuselage flies. The ornithopter further includes a drive unit (500), which operates the main wings, and a flight control unit (600), which has a receiver to receive a signal for controlling the drive unit and the tail rotor. The ornithopter further includes a remote controller (700), which transmits the signal for controlling the drive unit and the tail rotor to the receiver.

11 Claims, 16 Drawing Sheets

FOREIGN PATENT DOCUMENTS

| | | |
|---|---|---|
| KR | 20-0381806 | 4/2005 |
| KR | 10-0515031 | 9/2005 |
| KR | 10-0686136 | 9/2006 |
| KR | 10-2006-0110241 | 10/2006 |

OTHER PUBLICATIONS

English Abstract of KR 2003-0044625.
English Abstract of KR 10-0686136.

* cited by examiner (a)

(b)

REMOTE-CONTROLLED FLUTTERING OBJECT CAPABLE OF FLYING FORWARD IN UPRIGHT POSITION

TECHNICAL FIELD

The present invention relates, in general, to remote-controlled ornithopters capable of flying forward in an upright position and, more particularly, to a remote-controlled ornithopter which can fly forward in an upright position using flapping motion, like fairies in Sci-Fi movies or animations, and in which the flight thereof can be remote-controlled.

BACKGROUND ART

Generally, ornithopters have structures such that rotating shafts of drive motors are coupled to main wings through connecting rods and gear trains. In such an ornithopter, the main wings flaps using the rotating force of the rotating shaft of the drive motor. The ornithopter flies using aerodynamic lift generated by the flapping of the main wings.

FIG. 1 is a perspective view showing a conventional ornithopter. As shown in FIG. 1, the conventional ornithopter, which was proposed in Korean Patent Laid-open Publication No. 2003-0044625, and is entitled 'POWER-DRIVEN ORNITHOPTER PILOTED BY REMOTE CONTROLLER', includes a fuselage, main wings, horizontal tail wings, a battery, an electric motor, a servo motor and a main power transmission unit.

Furthermore, the conventional ornithopter, entitled 'POWER-DRIVEN ORNITHOPTER PILOTED BY REMOTE CONTROLLER', further includes a servo power transmission unit, which controls the horizontal tail wings depending on the rotation of the servo motor, and a controller, which controls the direction in which the servo motor is rotated and the rpm of the servo motor.

The conventional ornithopter, entitled 'POWER-DRIVEN ORNITHOPTER PILOTED BY REMOTE CONTROLLER' further includes a second servo motor and a vertical tail wing, which control the flight direction, as well as including the horizontal tail wings and the servo motor for controlling the horizontal tail wings.

As such, the conventional ornithopter includes a pair of main wings, and uses the principle in which it flies using the flapping of the main wings.

However, in the case of the ornithopter having one pair of main wings, it is difficult to generate sufficient aerodynamic lift and thrust to lift the weight of the ornithopter.

Even if sufficient aerodynamic lift and thrust are generated by the one pair of main wings, because the moment applied to the fuselage markedly varies depending on the position of the wings while flapping, there is a problem in that the air flow generated around the ornithopter by the flapping of the main wings is unsteady.

Therefore, forward flight in an upright position cannot be realized, because the balance of the ornithopter, which is an important factor for the forward flight in an upright position, is not maintained.

Another example of conventional ornithopters was proposed in Korean Patent Registration No. 10-0515031, entitled 'PROPULSION SYSTEM MIMICKING HOVERING FLAPPING WING'.

This technique, entitled 'PROPULSION SYSTEM MIMICKING HOVERING FLAPPING WING', implements the flapping of a hummingbird, which is the only bird capable of hovering.

However, the technique, entitled 'PROPULSION SYSTEM MIMICKING HOVERING FLAPPING WING', pertains to hovering rather than to forward flight in an upright position. Furthermore, because the construction of the technique and a method of implementing it are complex, it is very difficult to realize the technique.

Another example of conventional ornithopters was proposed in Korean Patent Laid-open Publication No. 2006-0110241, entitled 'DRAGONFLY-TYPE ORNITHOPTER WITH TWO PAIRS OF WING'. In this technique, two pairs of wings are disposed at front and rear positions to realize a dragonfly type ornithopter.

In the technique, entitled 'DRAGONFLY-TYPE ORNITHOPTER WITH TWO PAIRS OF WING', aerodynamic lift and thrust can be controlled by adjusting the difference in phase between the front and rear wings, so that the ornithopter can conduct a very difficult flight as well as hovering.

However, the technique, entitled 'DRAGONFLY-TYPE ORNITHOPTER WITH TWO PAIRS OF WING', is also an invention that pertains to hovering rather than to forward flight in an upright position. In other words, the object of this technique is different from that of the present invention for forward flight in an upright position.

Furthermore, in the technique, entitled 'DRAGONFLY-TYPE ORNITHOPTER WITH TWO PAIRS OF WING', even though the front wings and the rear wings have an exactly opposite phase difference there between, because the front wings are provided on the front part of the fuselage and the rear wings are provided on the rear part of the fuselage, vibration applied to the front part of the fuselage and vibration applied to the rear part of the fuselage have opposite phases, based on the space between the front wings and the rear wings. Therefore, it is impossible to conduct stable forward flight in the upright position.

Meanwhile, as conventional methods of remote-controlling the ornithopters using remote controllers, there are a method of remote-controlling an ornithopter by moving control sticks or circular rotating switches, which are provided on the remote controller, in desired directions, or a method in which switches are provided at left and right positions on a remote controller so that the orientation of an ornithopter varies depending on whether the left and right switches are pushed.

However, because these remote-control methods are well-known methods that have been used for a long time, there is a disadvantage in that the sense of realism in performing remote control is reduced and a user may become easily bored, soon losing interest.

In an effort to overcome the problems experienced with the conventional remote-control methods, a technique in which an object is remote-controlled by tilting or rotating a remote controller having a sensor was proposed in Korean Patent Laid-open Publication No. 2004-0056891, entitled 'LOCATION DETECTION SENSOR USING PHOTOINTERRUP AND ITS APPLICATION TO CONTROLLER'.

However, there are disadvantages in that the method of installing the sensor in the controller and the mechanism thereof are very complex, and the cost of materials increases due to the use of the sensor.

DISCLOSURE OF INVENTION

Technical Problem

Accordingly, the present invention has been made keeping in mind the above problems occurring in the prior art, and an object of the present invention is to provide a remote-controlled ornithopter capable of flying forward in the upright position, in which two pairs of main wings are provided in an X arrangement, so that the main wings have an opposite phase difference while flapping and, therefore, the difference in pressure between space between the two pairs of main wings and space outside the main wings is increased, thus maximizing the aerodynamic lift.

Another object of the present invention is to provide a remote-controlled ornithopter capable of flying forward in the upright position in which, because the flapping of the two pairs of main wings acts like a pump, the thrust of the ornithopter can also be increased.

A further object of the present invention is to provide a remote-controlled ornithopter capable of flying forward in the upright position, in which, because the two pairs of main wings are operated in opposite phases, the moment that is applied to the fuselage can be maintained constant, so that air flow generated by the flapping can be generated more constantly and efficiently, thus making stable forward flight in the upright position, hovering flight, and low-speed flight possible.

Yet another object of the present invention is to provide a remote-controlled ornithopter capable of flying forward in the upright position which can be remote-controlled by a simple control method, for example, by tilting a remote controller to the left or the right.

Technical Solution

In order to accomplish the above objects, the present invention provides a remote-controlled ornithopter capable of flying forward in an upright position, including: a fuselage; X-shaped main wings provided on an upper surface of a front end of the fuselage; tail wings provided on an upper surface of a medial portion or an upper surface of a rear end of the fuselage; a tail rotor for controlling a direction in which the fuselage flies; a drive unit for operating the main wings; and a flight control unit, having a receiver to receive a control signal for controlling the drive unit and the tail rotor, so that operation of the drive unit and the tail rotor is controlled depending on the control signal transmitted to the receiver.

The main wings may includes: X-shaped arms crossing each other to have an "X" shape, the X-shaped arms being coupled to each other at a central portion thereof so as to be rotatable with respect to each other; two upper frames coupled to and extending from two respective upper ends of the X-shaped arms; an upper skin attached to the two upper frames; two lower frames coupled to two respective lower ends of the X-shaped arms; and a lower skin attached to the two lower frames.

The X-shaped arms may be configured such that the two upper ends of the X-shaped arms are bent downwards and the two lower ends of the X-shaped arms are bent upwards, so that, when the two upper ends and the two corresponding lower ends are disposed adjacent to each other, the upper frames are parallel to the lower frames.

Furthermore, each of the upper frames and the lower frames may be made of plastic and include: a main frame inserted into a corresponding end of the X-shaped arm; and a subsidiary frame extending from a portion of the main frame backwards, integrally, wherein each of the main frame and the subsidiary frame is reduced in a cross-sectional area towards an end thereof.

The tail wings may include: tail wing frames extending from respective opposite sides of the upper surface of the medial portion or the upper surface of the rear end of the fuselage outwards and upwards at predetermined inclinations, each of the tail wing frames having a closed curve shape; and a tail wing skin attached to the tail wing frames.

The tail rotor may include: an extension rod extending towards a space above the tail wings; a direction control motor provided on an end of the extension rod, the direction control motor having a rotating shaft; and a propeller provided on the rotating shaft of the direction control motor.

The drive unit may include a gear power transmission unit for operating the main wings. The gear power transmission unit may include: a drive motor to provide rotating force for flying the fuselage; a gear train to transmit the rotating force from the drive motor at reduced speed; two driven wheels engaging with respective opposite sides of a last gear of the gear train; two rotating cam arms extending outwards from center shafts of the two respective driven wheels; and two connecting rods coupling respective ends of the two rotating cam arms to the corresponding lower ends of the X-shaped arms, so that, when the rotating force is transmitted from the drive motor to the driven wheels through the gear train, the connecting rods swing the opposite ends of the X-shaped arms upwards and downwards around the central portion of the X-shaped arms.

The remote-controlled ornithopter capable of flying forward in an upright position may further include a remote controller to transmit the control signal for controlling the drive unit and the tail rotor.

The remote controller may include: a tilt sensing means for detecting a change in tilt relative to a direction of gravity; and a manipulation control part, having a transmitter to transmit the control signal, created depending on a change in tilt detected by the tilt sensing means, to the receiver of the flight control unit.

The tilt sensing means may include: a pair of tilt switches inclined at predetermined angles relative to a horizontal plane and provided to have a symmetrical structure, wherein each of the tilt switches comprises a movable member to be moved in the tilt switch to a first end or a second end of the tilt switch by a gravity depending on an angle at which the remote controller is tilted, wherein, when the movable member is brought into contact with the first end in the tilt switch, the tilt switch is turned ON, and, when the movable member is brought into contact with the second end in the tilt switch, the tilt switch is turned OFF.

The pair of tilt switches may be constructed such that, when the remote controller is tilted to a left, one tilt switch, which is disposed at a first position, is turned ON, and a remaining tilt switch, which is disposed at a second position, is turned OFF, so that the remote-controlled ornithopter flies to the left, and, when the remote controller is tilted to a right, the tilt switch, which is disposed at the first position, is turned OFF, and the tilt switch, which is disposed at the second position, is turned ON, so that the remote-controlled ornithopter flies to the right.

BEST MODE FOR CARRYING OUT THE INVENTION

Figure 1:
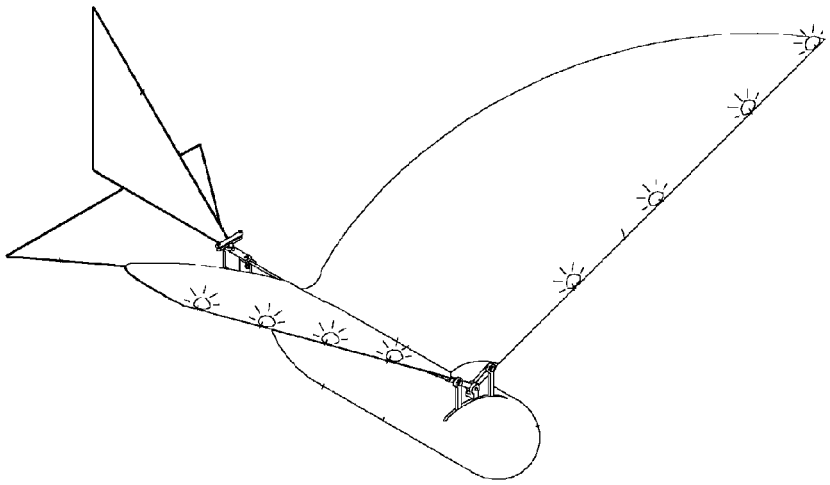
FIG. 1 PRIOR ART
FIG. 1 is a perspective view showing a conventional ornithopter.

A remote-controlled ornithopter capable of flying forward in the upright position according to an embodiment of the present invention includes a fuselage 100, main wings 200, tail wings 300, a tail rotor unit 400, a drive unit 500 and a flight control unit 600.

The remote-controlled ornithopter further includes a remote controller 700, which transmits control signals for controlling the drive unit 500.

The fuselage 100 forms the entire body of the remote-controlled ornithopter. The main wings 200 are provided on the upper surface of the front end of the fuselage 100, and conduct a flapping operation. The tail wings 300 are provided on the upper surface of the medial part or the rear end of the fuselage 100, and serve to maintain horizontal balance. The tail rotor unit 400 serves to change the direction in which the fuselage 100 flies. The drive unit 500 serves to operate the main wings 200. The flight control unit 600 has a receiver 610, which receives control signals for controlling the drive unit 500 and the tail rotor unit 400, and thus controls the drive unit 500 and the tail rotor unit 400 according to control signals transmitted to the receiver 610. The remote controller 700 includes a tilt sensing means 710, which detects a change in tilt relative to the direction of gravity, and a manipulation control part 720. The manipulation control part 720 has a transmitter 722, which transmits control signals, generated depending on changes in tilt detected by the tilt sensing means 710, to the receiver 610 of the flight control unit 600.

Next, the fuselage 100 will be explained.

The fuselage 100 supports thereon the main wings 200, the tail wings 300 and the tail rotor unit 400, which are critical parts for flight. As shown in FIGS. 2 through 5, the fuselage 100 may have the shape of a male fairy character.

Figure 19:
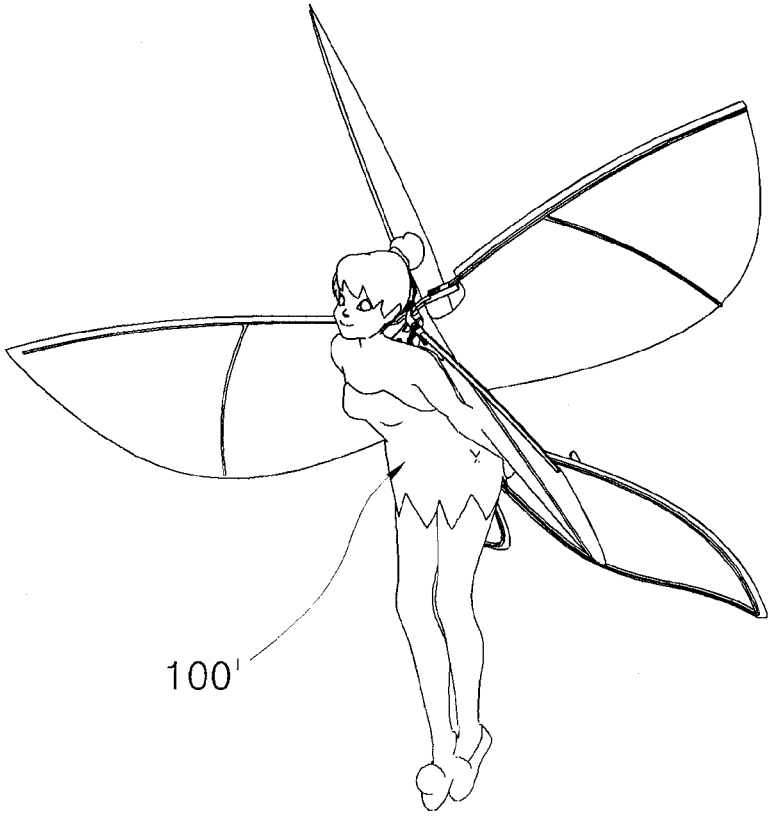
FIG. 19 is a view showing a fuselage of the remote-controlled ornithopter which has a shape of Tinkerbell, who is a female fairy character, according to the present invention.

Alternatively, as shown in FIG. 19, the fuselage 100 may have the shape of "Tinkerbell," who is a representative example of a female fairy character.

The main wings 200 will be explained herein below in detail.

Figure 2:
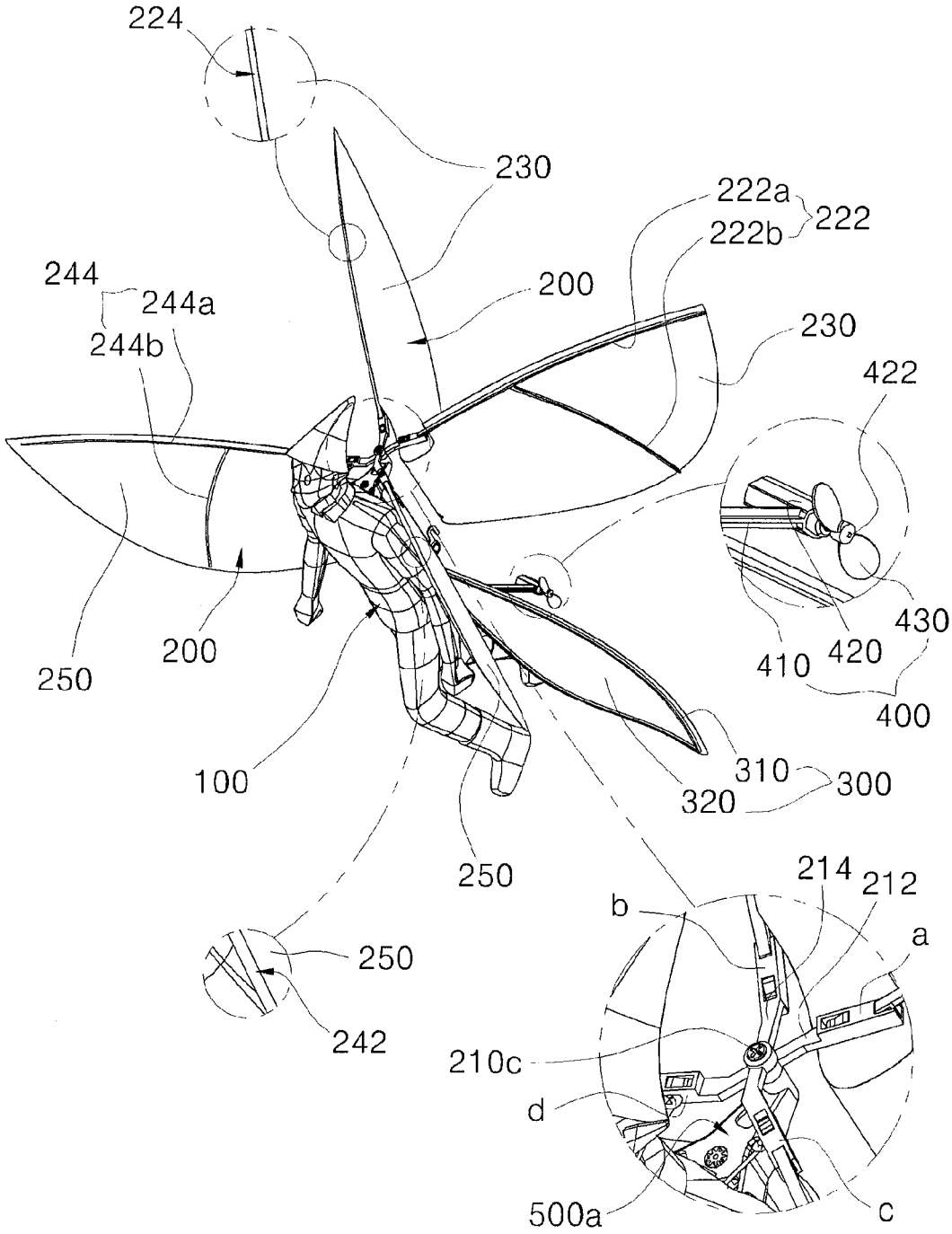
FIG. 2 is a perspective view of a remote-controlled ornithopter capable of flying forward in an upright position, according to an embodiment of the present invention.
Figure 3:
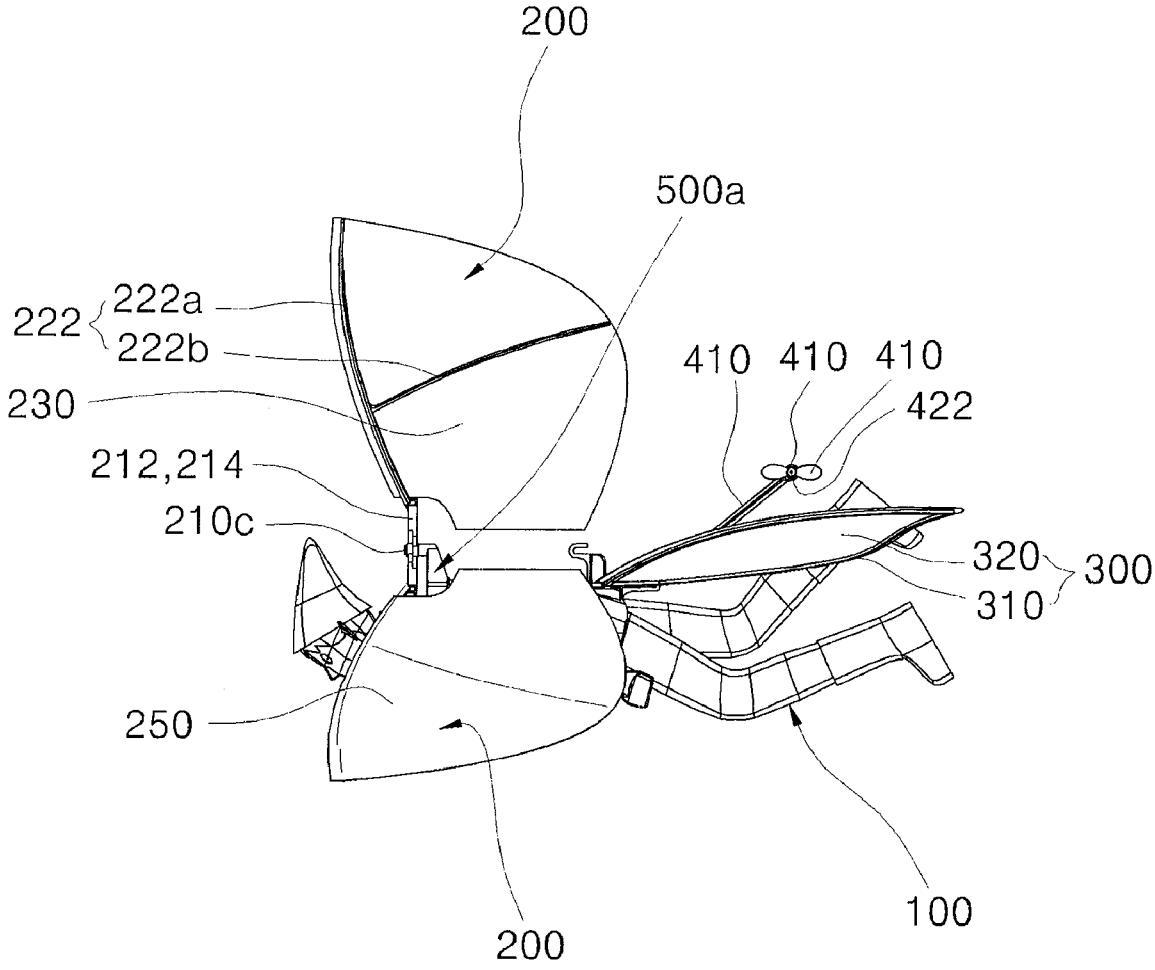
FIG. 3 is a side view of the remote-controlled ornithopter capable of flying forward in an upright position according to the embodiment of the present invention.
Figure 4:
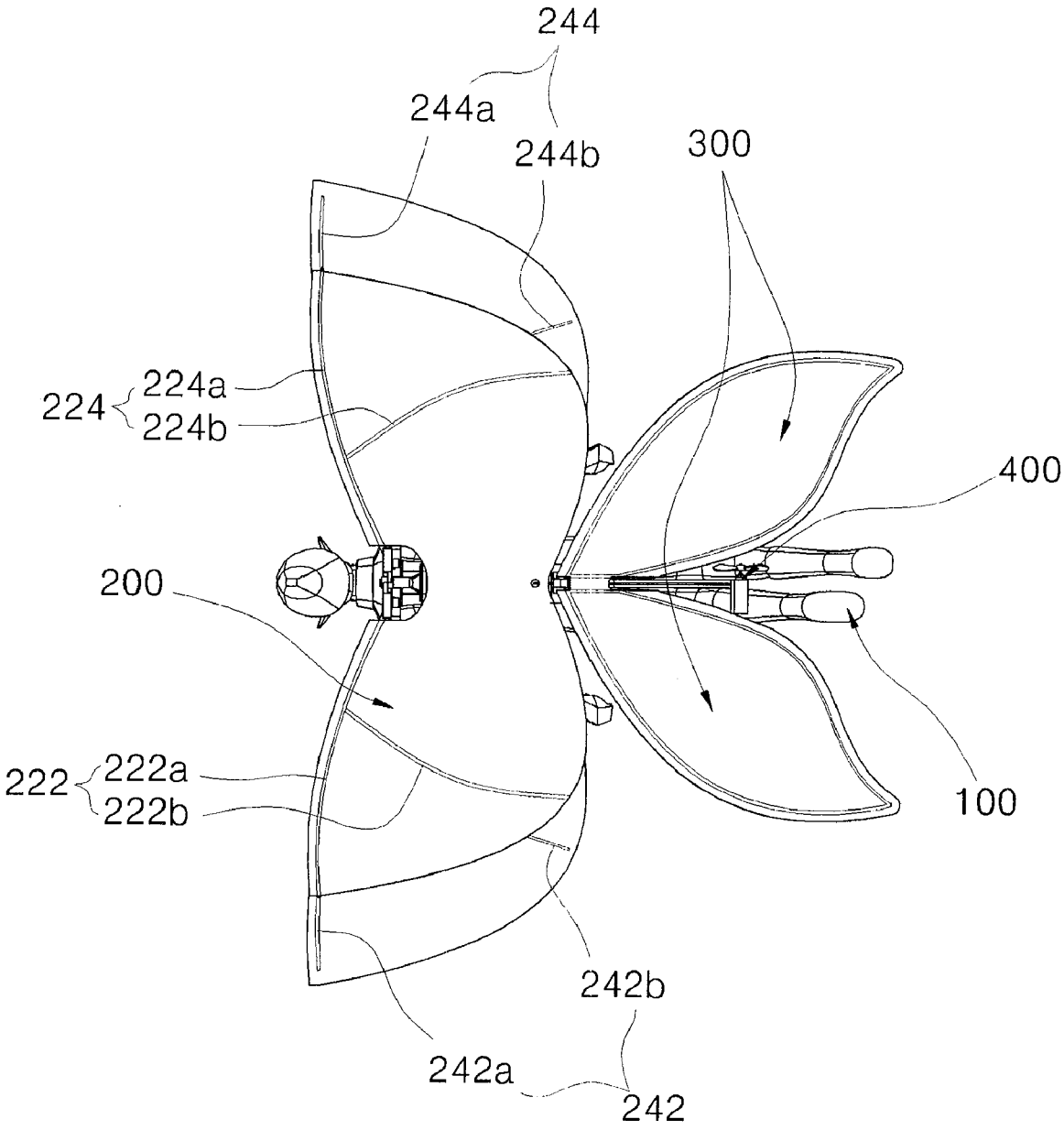
FIG. 4 is a plan view of the remote-controlled ornithopter capable of flying forward in an upright position according to the embodiment of the present invention.
Figure 5:
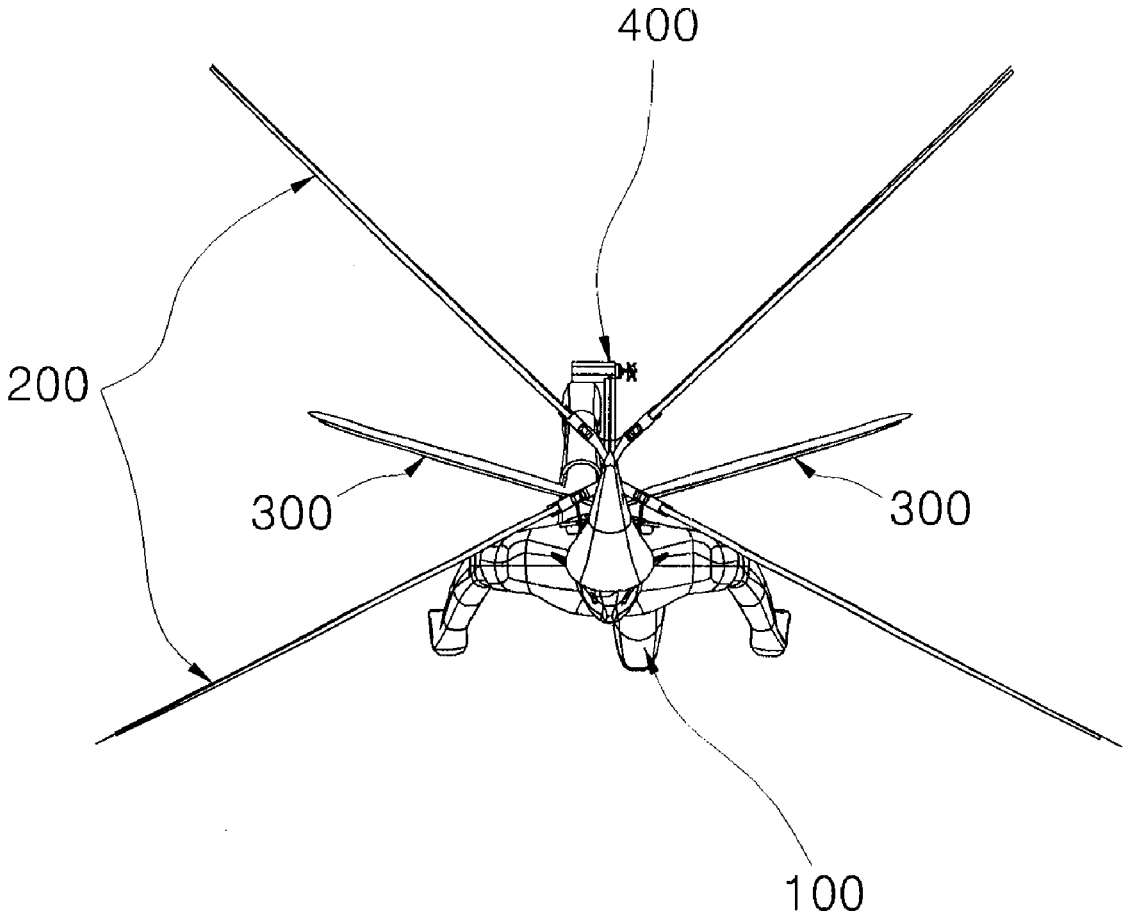
FIG. 5 is a front view of the remote-controlled ornithopter capable of flying forward in an upright position according to the embodiment of the present invention.

As shown in FIGS. 2 through 4, the main wings 200 are provided on the upper surface of the front end of the fuselage 100. As shown in FIG. 5, when seen in the front view, the main wings 200 have an "X" shape.

As basic structural elements, the main wings 200 include X-shaped arms 212 and 214, which cross each other to have an "X" shape and are rotatably connected to each other at a central portion 210*c* thereof. The main wings 200 further include upper frames 222 and 224, lower frames 242 and 244, upper skins 230 and lower skins 250.

Figure 9:
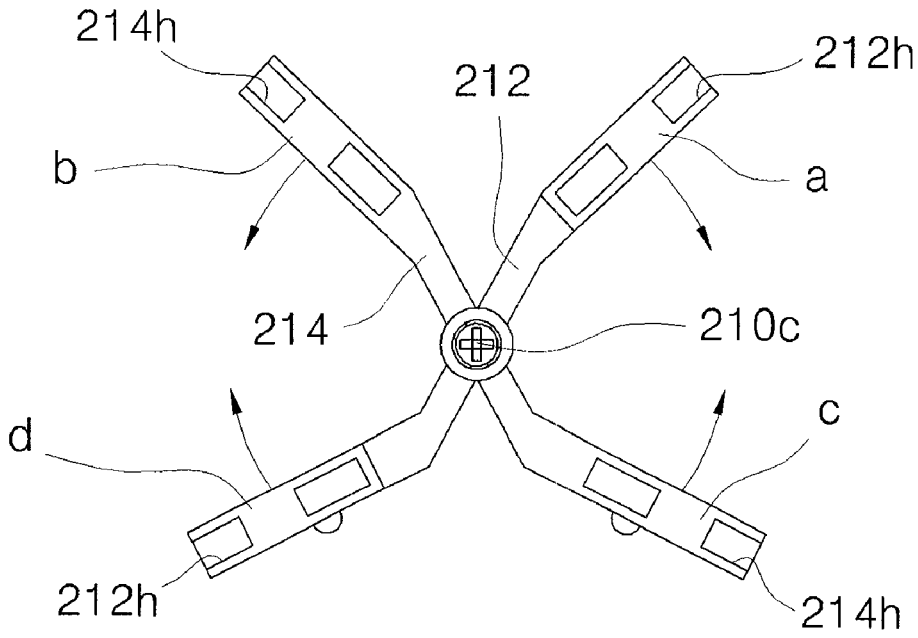
FIGS. 9 and 10 are views illustrating the operation of an X-shaped arm of the remote-controlled ornithopter, capable of flying forward in an upright position according to the embodiment of the present invention.
Figure 10:
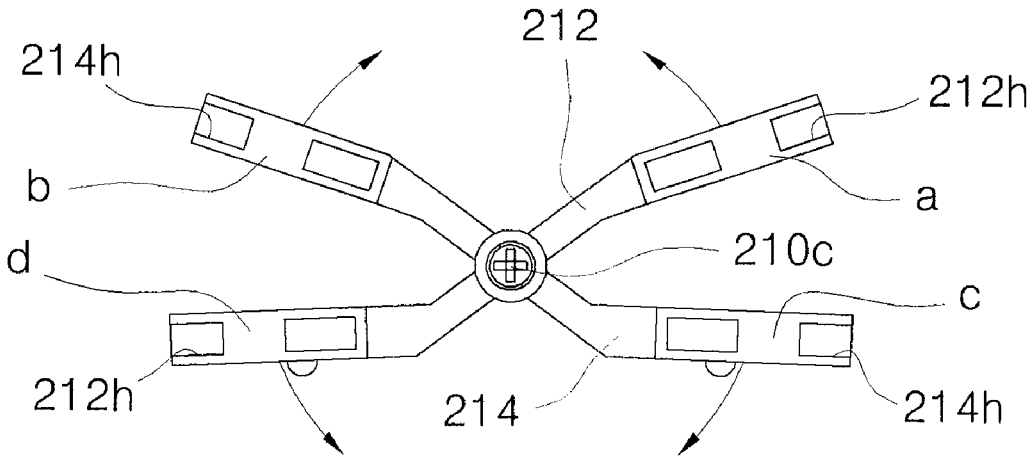

As shown in FIGS. 9 and 10, the X-shaped arms 212 and 214 are constructed such that the first arm 212 and the second arm 214 are rotatable with respect to each other in the state in which they cross each other on the central portion 210*c* thereof.

Furthermore, in the X-shaped arms 212 and 214, a pair of upper ends a and b is bent downwards, and a pair of lower ends c and d is bent upwards.

In detail, the X-shaped arms 212 and 214 are configured such that, when the upper ends a and b are closest to the corresponding lower ends c and d, the upper frames 222 and 224 are parallel to the lower frames 242 and 244.

The reason for this is that this construction can increase the flow rate, generated by flapping, and efficiently concentrate air flow in the correct direction, compared to the case where the ends a, b, c and d of the X-shaped arms 212 and 214 are not bent.

Meanwhile, insert seats 212*h* and 214*h* for insertion of the upper frames 222 and 224 and the lower frames 242 and 244 are formed in the ends a, b, c and d of the first arm 212 and the second arm 214.

The upper frames 222 and 224 are respectively coupled to and extend from the upper ends a and b of the X-shaped arms, and the lower frames 242 and 244 are respectively coupled to and extend from the lower ends c and d of the X-shaped arms.

In detail, the first upper frame 222 is inserted into the upper end a of the first arm 212, and the second upper frame 224 is inserted into the upper end b of the second arm 214.

Furthermore, the second lower frame 244 is inserted into the lower end d of the first arm 212. The first lower frame 242 is inserted into the lower end c of the second arm 214.

Each of the upper and lower frames 222, 224, 242 and 244 includes a main frame 222*a*, 224*a*, 242*a*, 244*a* and a subsidiary frame 222*b*, 224*b*, 242*b*, 244*b*.

The main frames 222*a*, 224*a*, 242*a* and 244*a* are inserted into the corresponding insert seats 212*h* and 214*h*, which are formed in the upper and lower ends a, b, c and d of the X-shaped arms 212 and 214.

Each subsidiary frame 222*b*, 224*b*, 242*b*, 244*b* integrally extends at a predetermined position from the corresponding main frame 222*a*, 224*a*, 242*a*, 244*a* rearwards.

In other words, as shown in FIGS. 2 and 3, the main frame 222*a* of the first upper frame 222 is inserted into the upper end a of the first arm 212, and the subsidiary frame 222*b* integrally extends at a predetermined position from the main frame 222*a* of the first upper frame 222 rearwards.

In addition, the main frame 224*a* of the second upper frame 224 is inserted into the upper end b of the second arm 214, and the subsidiary frame 224*b* integrally extends at a predetermined position from the main frame 224*a* of the second upper frame 224 rearwards.

The main frame 242*a* of the first lower frame 242 is inserted into the lower end c of the second arm 214, and the subsidiary frame 242*b* integrally extends rearwards from a predetermined position on the main frame 242*a* of the first lower frame 242.

The main frame 244*a* of the second lower frame 244 is inserted into the lower end d of the first arm 212, and the subsidiary frame 244*b* integrally extends rearwards from a predetermined position on the main frame 244*a* of the second lower frame 244.

Preferably, the main frames 222*a*, 224*a*, 242*a* and 244*a* and the subsidiary frames 222*b*, 224*b*, 242*b* and 244*b* are made of plastic, for example, POM (polyacetal), PC (polycarbonate), etc.

Therefore, as shown in FIGS. 3 and 4, each of the main frames 222*a*, 224*a*, 242*a*, 244*a* and the subsidiary frames 222*b*, 224*b*, 242*b* and 244*b* can be curved. Using the above characteristics, the main frames 222*a*, 224*a*, 242*a* and 244*a* are configured such that they are convex towards the front end of the fuselage 100 at a predetermined curvature, thus increasing the area of the wings, thereby increasing dynamic lift.

Furthermore, because the subsidiary frames 222*b*, 224*b*, 242*b* and 244*b* respectively extend from the central portion of the main frames 222*a*, 224*a*, 242*a* and 244*a* rearwards, air flow, which flows along the fuselage 100, can be effectively guided behind the rear end of the main frames 222*a*, 224*a*, 242*a* and 244*a*. Hence, the thrust of the ornithopter can be increased.

Moreover, each of the main frames 222*a*, 224*a*, 242*a* and 244*a* and the subsidiary frames 222*b*, 224*b*, 242*b* and 244*b* is configured such that the cross-sectional area thereof is reduced from the inner end to the outer end thereof. Therefore, the flexibility of the frames is enhanced, so that air can efficiently flow through the frames. Thus, there is an effect in that the thrust of the ornithopter can be increased.

As such, in the embodiment of the present invention, there are effects in that the aerodynamic lift and the thrust of the ornithopter can be increased thanks to the shapes of the main frames 222*a*, 224*a*, 242*a* and 244*a* and the subsidiary frames 222*b*, 224*b*, 242*b* and 244*b*. However, in the conventional ornithopter, because the reinforcing frames of wings are manufactured using rods made of carbon, it is impossible to form them in curved shapes, and a change in thickness thereof with respect to the longitudinal direction cannot be realized.

Furthermore, in the case using plastic, there are advantages in that the frames can be easily adapted for mass production, and, because the cost of material for the frames is lower than that of the conventional art, using carbon, the production costs thereof are markedly reduced, and productivity and the marketability thereof are increased.

The upper skin 230 is attached to both of the upper frames 222 and 224. The lower skin 250 is attached to both of the lower frames 242 and 244. Preferably, each of the upper skin 230 and the lower skin 250 has an area sufficient to provide aerodynamic lift.

Below, the operation of the main wings 200 having the above-mentioned construction will be explained.

The first arm 212 and the second arm 214 of the X-shaped arms 212 and 214 are symmetrically rotated around the central portion 210*c* thereof with respect to each other. Thereby, the upper frames 222 and 224 and the lower frames 242 and 244 are operated.

Here, the upper skin 230, which is attached to the upper frames 222 and 224, coupled to the X-shaped arms 212 and 214, and the lower skin 250, which is attached to the lower frames 242 and 244, coupled to the X-shaped arms 212 and 214, are operated in opposite phases.

In detail, when the opposite ends of the upper skin 230, which are attached to the upper frames 222 and 224, are swung upwards, the opposite ends of the lower skin 250, which are attached to the lower frames 242 and 244, are swung downwards.

In contrast, when the opposite ends of the upper skin 230, which are attached to the upper frames 222 and 224, are swung downwards, the opposite ends of the lower skin 250, which are attached to the lower frames 242 and 244, are swung upwards.

As such, in the present invention, the opposite ends of the upper skin 230, which are attached to the upper frames 222 and 224, and the opposite ends of the lower skin 250, which are attached to the lower frames 242 and 244, are operated in opposite phases. Therefore, the moment that is generated by the flapping of the main wings provided with the upper skin 230, and the moment that is generated by the flapping of the main wings provided with the lower skin can offset each other.

Because the moment generated by the flapping of the main wings having the upper skin 230 and the moment generated by the flapping of the main wings having the lower skin 250 offset each other, the moment applied to the fuselage 100 can be maintained constant. As a result, stable flight of the fuselage 100 is ensured.

Figure 6:
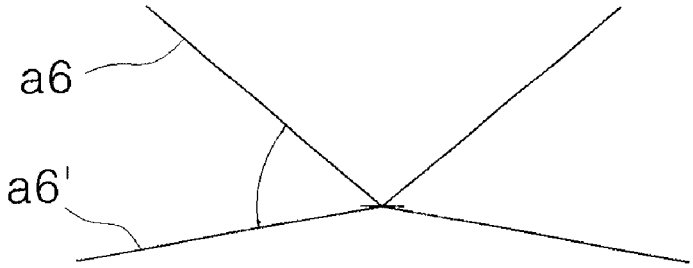
FIG. 6 is views (a) and (b) illustrating a flapping range of an ornithopter having one pair of main wings and a flapping range of an ornithopter having two pairs of main wings, respectively.
Figure 6:
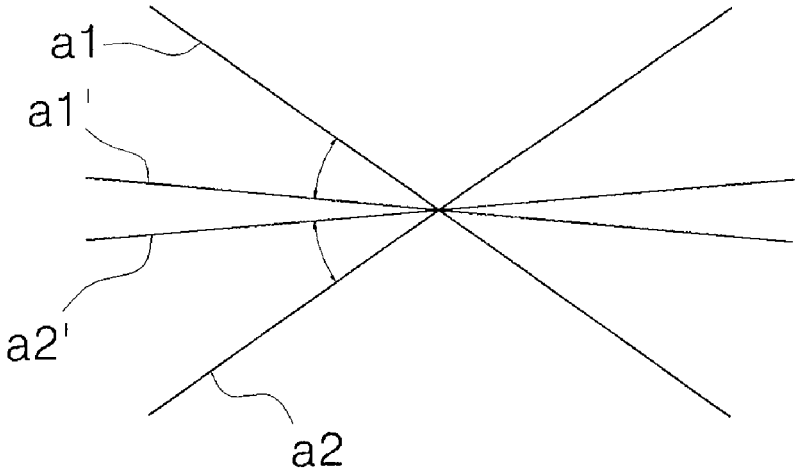

Meanwhile, FIG. 6 is views (a) and (b), illustrating the flapping range of an ornithopter having a pair of main wings and the flapping range of an ornithopter having two pairs of main wings, respectively.

If the ornithopter having two pairs of main wings is constructed such that the angle between a1 and a1' of FIG. 6(*b*) is equal to the angle between a6 and a6' of FIG. 6(*a*), the energy consumption thereof is greater than that of the ornithopter having one pair of main wings.

However, if the angle between a1 and a1' of FIG. 6(*b*) is within an appropriate range, which is less than the angle between a6 and a6' of FIG. 6(*a*), the energy consumption of the ornithopter having two pairs of main wings is less than or similar to that of the ornithopter having one pair of main wings.

Therefore, in the case where the two pairs of main wings are operated in opposite phases, the aerodynamic lift can be maximized, and, because the flapping of the two pairs of main wings acts like a pump, constant air flow can be efficiently formed around the fuselage, thus enhancing the thrust.

Ultimately, compared to the flapping of one pair of main wings, the flapping of two pairs of main wings of the present invention can enhance electric energy efficiency with respect to the aerodynamic lift and electric energy efficiency with respect to the thrust.

Below, the tail wings 300 will be explained.

The tail wings 300 may be provided on the upper surface of the medial portion or the upper surface of the rear end of the fuselage 100. In this embodiment, as shown in FIGS. 2 and 5, the tail wings 300 are provided on the upper surface of the medial portion of the fuselage 100.

As shown in FIG. 4, each tail wing 300 has an approximate leaf shape, and extends backwards.

In detail, as shown in FIG. 2, the tail wings 300 include tail wing frames 310, each of which has a closed curve shape, and which extend from the respective opposite sides of the upper surface of the medial portion or the upper surface of the rear end of the fuselage 100 outwards and upwards at predetermined inclinations, and a tail wing skin 320, which is attached to all of the tail wing frames 310.

Each tail wing frame 310 has a leaf-shaped closed curve shape.

The tail wings 300 are slightly inclined upwards such that the opposite ends thereof are disposed at upper positions, so that the tail wings 300 generally form a V shape. This shape ensures pitching stability and stable straight motion when the fuselage 100 flies forwards in the upright position.

The tail wings 300 having the above-mentioned construction serve to ensure stable flight when the fuselage 100 flies using the motion of the main wings 200.

Next, the tail rotor unit 400 will be explained in detail.

The tail rotor unit 400 serves to control the direction in which the fuselage 100 flies. As shown in FIG. 2, the tail rotor unit 400 includes an extension rod 410, which extends from the fuselage towards the space above the tail wings 300, a direction control motor 420, which is provided on the end of the extension rod 410 and has a rotating shaft 422, and a propeller 430, which is provided on the rotating shaft 422 of the direction control motor 420.

As shown in FIGS. 3 and 4, the extension rod 410 extends from the fuselage 100 such that the end thereof is disposed above the medial portion of the tail wings 300.

The direction control motor 420, which is provided on the end of the extension rod 410, is rotated so as to be reversible. The propeller 430 is fitted over the rotating shaft 422 of the direction control motor 420.

Therefore, depending on the forward rotation or reverse rotation of the propeller 430 of the direction control motor 420, the direction in which the fuselage 100 flies can be controlled to the left or the right.

Below, the drive unit 500 will be explained.

The drive unit 500 serves to operate the main wings 200 such that the main wings 200 flapping and, more particularly, so as to control the speed at which the main wings 200 flapping.

To achieve the above purpose, the drive unit 500 includes a gear power transmission unit **500*a* for the flapping of the main wings 200**.

The gear power transmission unit **500*a* includes a drive motor 510, a gear train, a pair of driven wheels 532 and 534, a pair of rotating cam arms 542 and 544, and a pair of connecting rods 552 and 554**.

The drive motor 510 provides rotating force for flying the fuselage 100. The gear train transmits the rotating force from the drive motor 510 to the driven wheels 532 and 534 at reduced speed.

The driven wheels 532 and 534 engage with opposite sides of the last gear of the gear train. The rotating cam arms 542 and 544 respectively extend from the center shafts of the driven wheels 532 and 534 outwards such that the ends thereof are disposed adjacent to the respective circumferential outer edges of the driven wheels 532 and 534.

The connecting rods 552 and 554 respectively couple the ends of the rotating cam arms 542 and 544 to the lower ends c and d of the X-shaped arms 212 and 214. Thus, when the rotating force is transmitted from the drive motor 510 to the driven wheels 532 and 534 through the gear train, the connecting rods 552 and 554 swing the opposite ends of the X-shaped arms 212 and 214 upwards and downwards around the central portion **210*c* of the X-shaped arms 212 and 214**.

Figure 7:
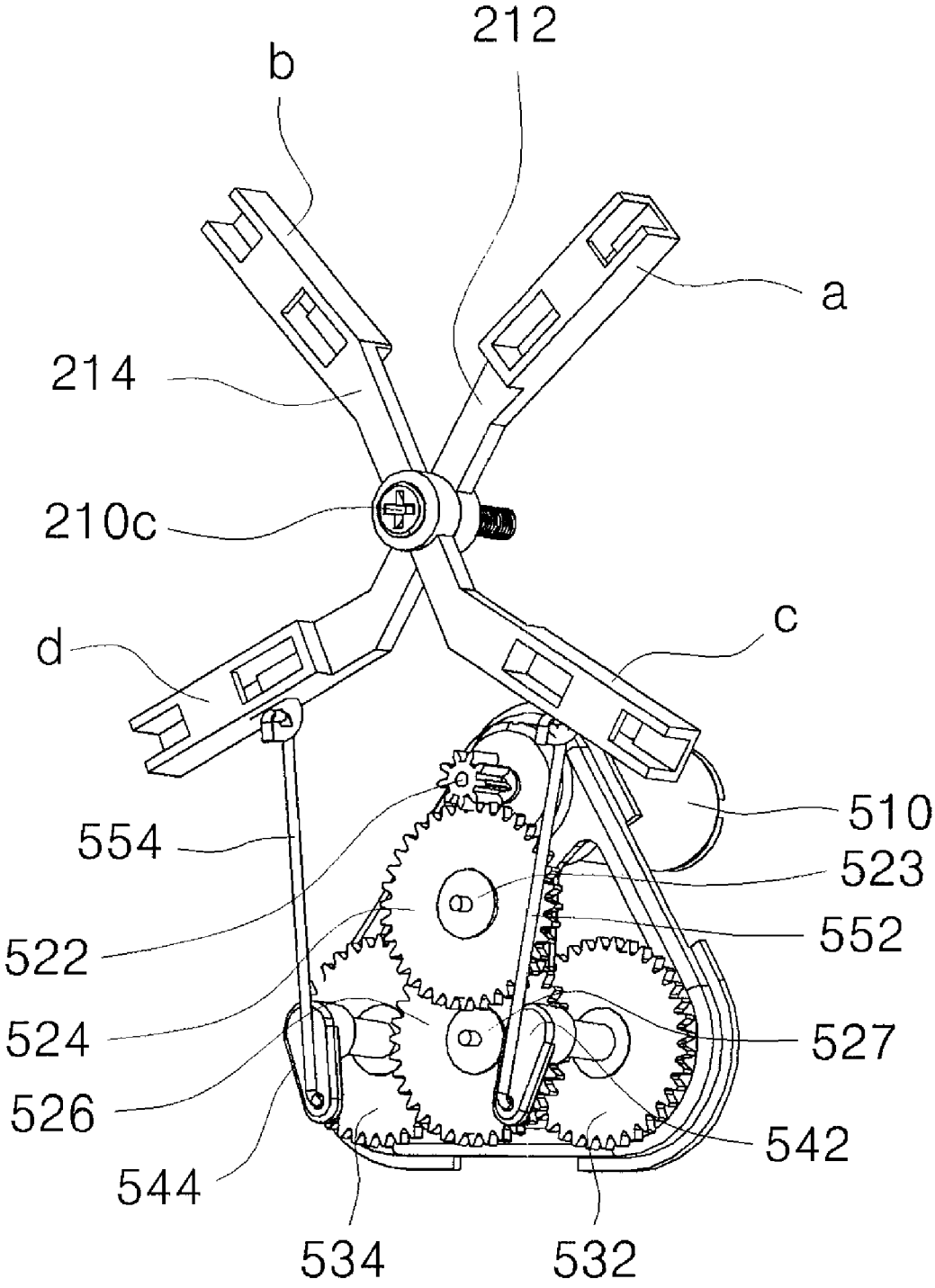
FIG. 7 is a perspective view showing a gear power transmission unit of the remote-controlled ornithopter capable of flying forward in an upright position according to the embodiment of the present invention.
Figure 8:
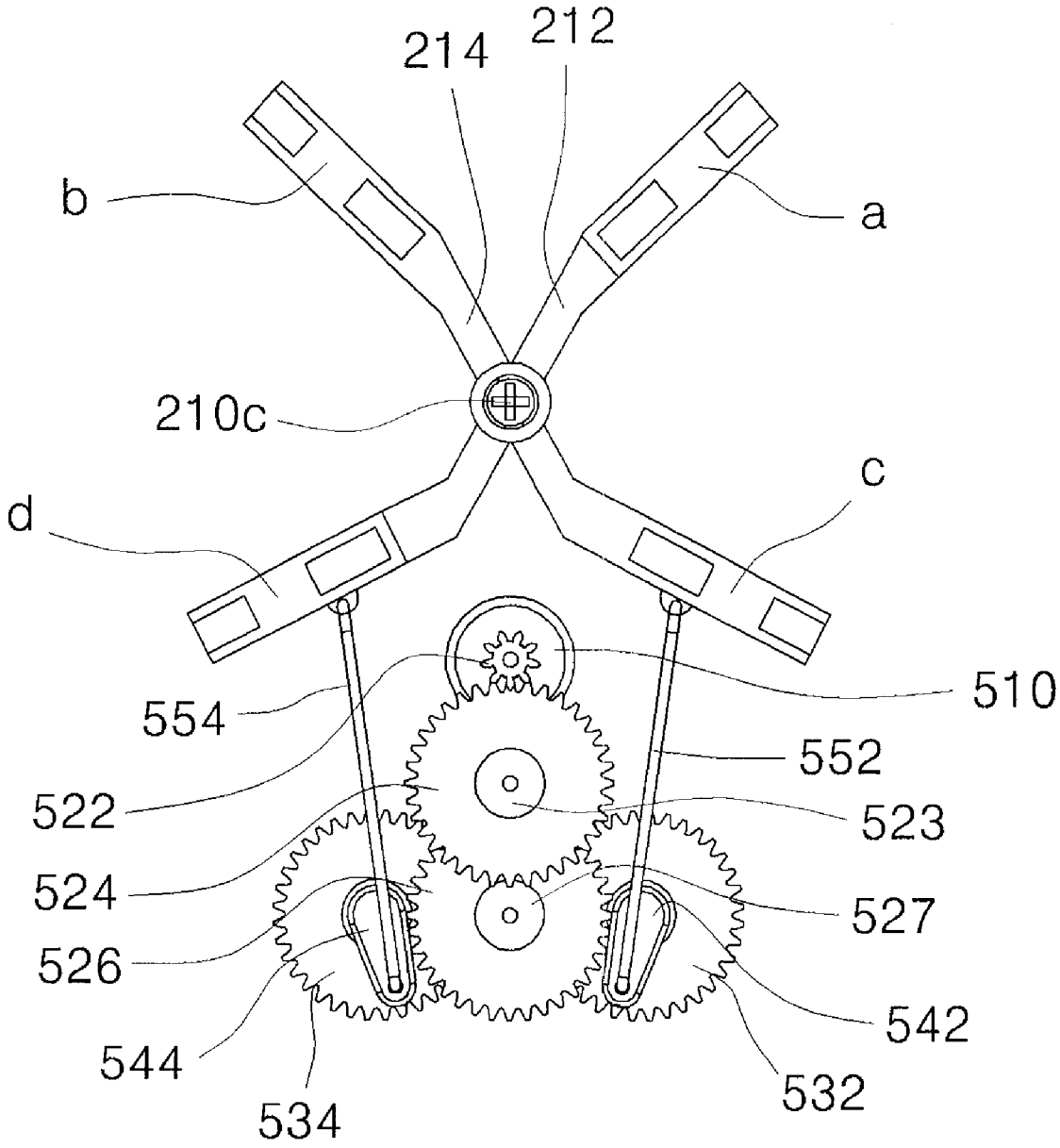
FIG. 8 is a front view showing the gear power transmission unit of the remote-controlled ornithopter capable of flying forward in an upright position according to the embodiment of the present invention.

As shown in FIGS. 7 and 8, the gear train includes a plurality of gear wheels, which are connected to and operated along with the driven wheels 532 and 534.

A first gear wheel 522 is fitted over the rotating shaft of the drive motor 510, and is rotated at the same speed as the rotating shaft. A first external gear having a G1 number of gear teeth is provided on the first gear wheel 552.

A second gear wheel 524 has a second external gear, which engages with the first external gear and has a G2 number of gear teeth. A third gear wheel 523 is coaxial with the second gear wheel 524, and thus rotates at the same speed as the second gear wheel 524. A third external gear having a G3 number of gear teeth is provided on the third gear wheel 523 (the third external gear is formed on the rear surface of the third gear wheel 523 when seen in FIG. 7).

The second gear wheel 524 and the third gear wheel 523 may be integrally formed.

A fourth external gear, which engages with the third external gear and has a G4 number of gear teeth, is formed on a fourth gear wheel 526.

A fifth gear wheel 527 (the last gear) is coaxial with the fourth gear wheel 526, and thus rotates at the same speed as the fourth gear wheel 526. A fifth external gear having a G5 number of gear teeth is formed on the fifth gear wheel 527 (the fifth external gear is formed on the rear surface of the fifth gear wheel 527 when seen in FIG. 7).

A sixth external gear, having a G6 number of gear teeth, and a seventh external gear, having a G7 number of gear teeth, are respectively formed on the circumferential outer edges of the driven wheel 532 and 534, which are respectively coupled to the first connecting rod 552 and the second connecting rod 554. The G6 number is the same as the G7 number. The sixth external gear and the seventh external gear engage with the fifth external gear.

A process of transmitting the rotating force of the drive motor 510 through the gear train having the above-mentioned structure will be described herein below.

When the rotating shaft of the drive motor 510 is rotated in a clockwise direction, the first external gear is also rotated in a clockwise direction, at the same speed as the rotating shaft, and the second external gear is rotated in a counterclockwise direction at a speed reduced to a ratio of G1/G2 relative to the speed of the first external gear.

The third external gear is rotated in a counterclockwise direction at the same speed as that of the second external gear. The fourth external gear is rotated in a clockwise direction at a speed reduced to a ratio of G3/G4 relative to the speed of the third external gear.

The fifth external gear is also rotated in a clockwise direction at the same speed as the fourth external gear. Thereby, the sixth external gear and the seventh external gear are rotated in a counterclockwise direction at a speed reduced to a ratio of G5/G6 (=G5/G7) relative to the speed of the fifth gear teeth.

As a result, the first driven wheel 532 and the second driven wheel 534 are rotated at a speed reduced to an appropriate ratio (of G1*G3*G5/G2*G5*G6) relative to the speed of the rotating shaft of the drive motor 510 in a direction opposite the direction in which the rotating shaft of the drive motor 510 is rotated.

Meanwhile, the rotating cam arms 542 and 544 are coupled to respective driven wheels 532 and 534, which are rotated at a speed reduced to an appropriate ratio.

The rotating cam arms 542 and 544 radially extend from the center shafts of the driven wheels 532 and 534 outwards, respectively, such that the outer ends thereof are disposed adjacent to the circumferential outer edges of the driven wheels 532 and 534.

The outer ends of the rotating cam arms 542 and 544 are connected to the lower ends c and d of the X-shaped arms 212 and 214 through the connecting rods 552 and 554, respectively.

In the above-mentioned construction, when the driven wheels 532 and 534 are rotated, the outer ends of the rotating cam arms 542 and 544 are respectively rotated along the circumferential outer edges of the driven wheels 532 and 534. Then, the X-shaped arms 212 and 214 are swung around the central portion 210*c* by the connecting rods 552 and 554, which are respectively coupled to the outer ends of the rotating cam arms 542 and 544 in the state in which the first arm 212 and the second arm 214 cross each other (refer to FIGS. 9 and 10).

As such, when the first arm 212 and the second arm 214 are swung around the central portion 210*c* thereof in the state in which they cross each other, the upper frames 222 and 224 and the lower frames 242 and 244, which are coupled to the first arm 212 and the second arm 214, are also swung.

As a result, the opposite ends of the upper skin 230 and the opposite ends of the lower skin 250 are moved in opposite phases.

Here, the drive unit 500 can control the speed at which the main wings 200 flapping through the gear power transmission unit 500*a* while operating the main wings 200.

The flight control unit 600 will be explained herein below.

The flight control unit 600 includes the receiver 610, which receives control signals for controlling the drive unit 500 and the tail rotor unit 400. Thus, the flight control unit 600 serves to control the drive unit 500 and the tail rotor unit 400 according to control signals transmitted to the receiver 610.

In detail, the receiver 610 receives control signals transmitted from the remote controller 700, which will be explained later herein. According to the control signals transmitted to the receiver 610, the flight control unit 600 controls the operation of the drive unit 500 and the tail rotor unit 400.

Here, the control signals, which are transmitted to the receiver 610, include a signal for controlling the rotating speed of the drive motor 510 to control the flapping speed of the main wings 200, and a signal for controlling the direction in which the direction control motor 420 is rotated to control the orientation of the fuselage 100.

Finally, the remote controller 700 for controlling the remote-controlled ornithopter, including the fuselage 100, the main wings 200, the tail wings 300, the tail rotor unit 400, the drive unit 500, and the flight control unit 600, will be explained herein below.

The remote controller 700 serves to control the flight of the remote-controlled ornithopter. For this, the remote controller 700 transmits signals for controlling the flapping speed of the main wings 200 and signals for controlling the direction in which the direction control motor 420 of the tail rotor unit 400 is rotated, such that the direction control motor 420 is rotated in a forward or reverse direction.

The control signals, which are generated from the remote controller 700, are transmitted to the receiver 610 of the flight control unit 600. Using the transmitted control signals, the flight control unit 600 controls the operation of the drive unit 500 and the tail rotor unit 400.

The remote controller 700 includes a speed control button 700*a*, an ON-OFF switch 700*b*, the tilt sensing means 710 and the manipulation control part 720.

Figure 11:
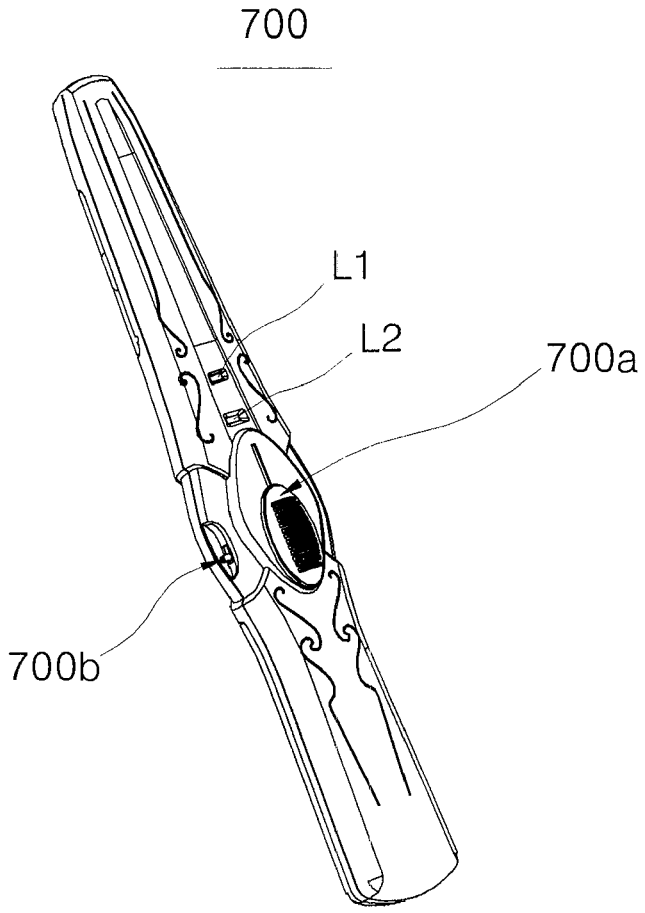
FIG. 11 is a perspective view showing a remote controller of the ornithopter capable of flying forward in an upright position according to the embodiment of the present invention.

As shown in FIG. 11, the speed control button 700*a* serves to control the speed at which the main wings 200 flap. The remote controller creates control signals such that the speed at which the main wings flapping varies depending on the degree to which the speed control button 700*a* is slid upwards.

That is, the remote controller creates control signals such that, when the speed control button 700*a* is moved slightly upwards, the drive motor 510 is rotated at a relatively low rpm, so that the speed at which the main wings 200 flap is relatively low. The remote controller creates control signals such that, when the speed control button 700*a* is moved upwards a large amount, the drive motor 510 is rotated at a relatively high rpm, so that the speed at which the main wings 200 flap is relatively high.

The tilt sensing means 710 creates a control signal for controlling the direction in which the fuselage 100 flies. In other words, the tilt sensing means 710 creates a control signal for controlling the direction in which the direction control motor 420 of the tail rotor unit 400 is rotated such that the direction control motor 420 is rotated in a forward or reverse direction.

Figure 12:
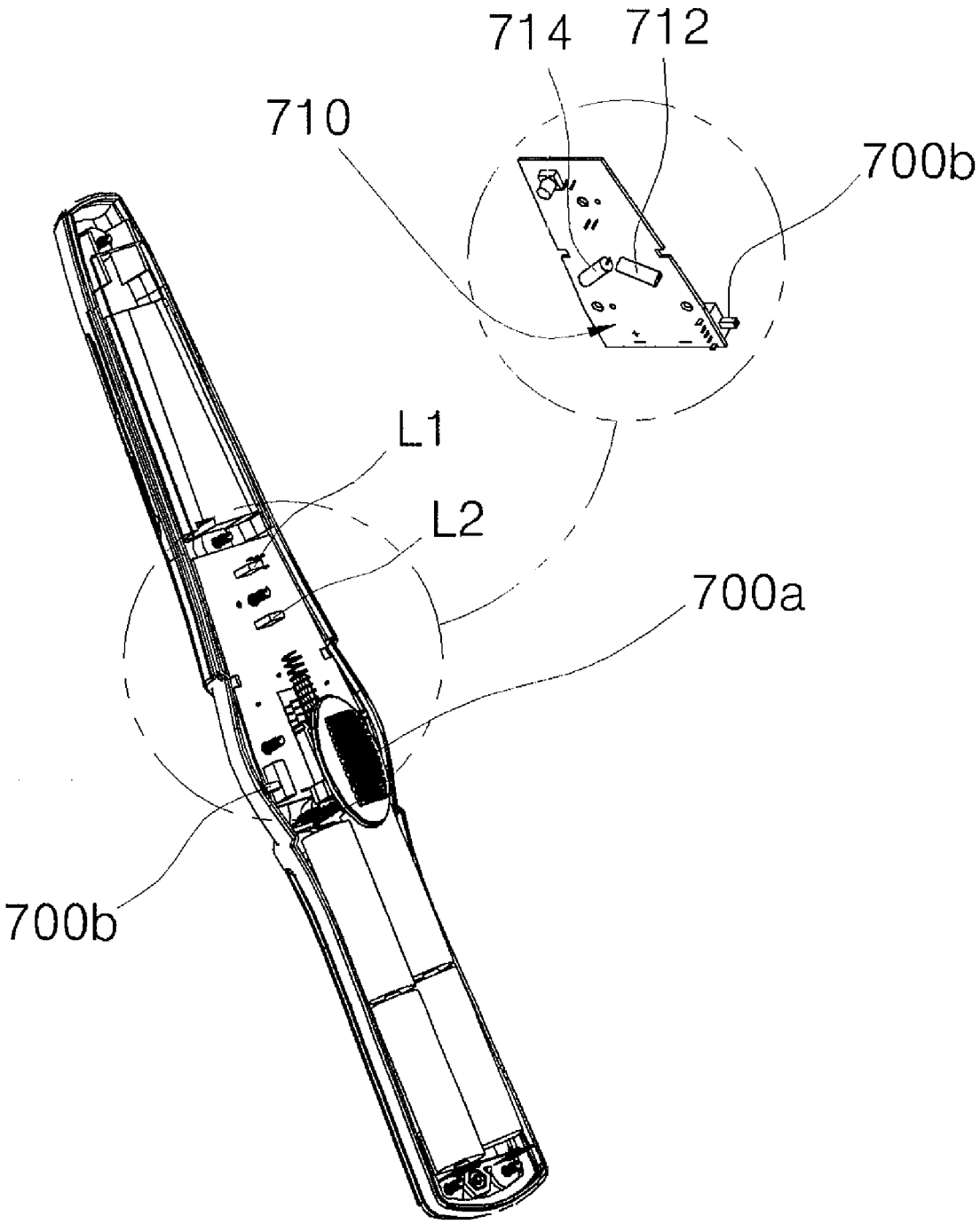
FIG. 12 is an exploded perspective view showing the remote controller of the ornithopter capable of flying forward in an upright position according to the embodiment of the present invention.

In detail, the tilt sensing means 710 detects the tilting angle at which a user tilts the remote controller 700 to the left or the right with respect to the direction of gravity. As shown in FIG. 12, the tilt sensing means 710 includes a pair of tilt switches 712 and 714, which are inclined at predetermined angles relative to the horizontal plane, and are provided to have a symmetrical structure.

Figure 13:
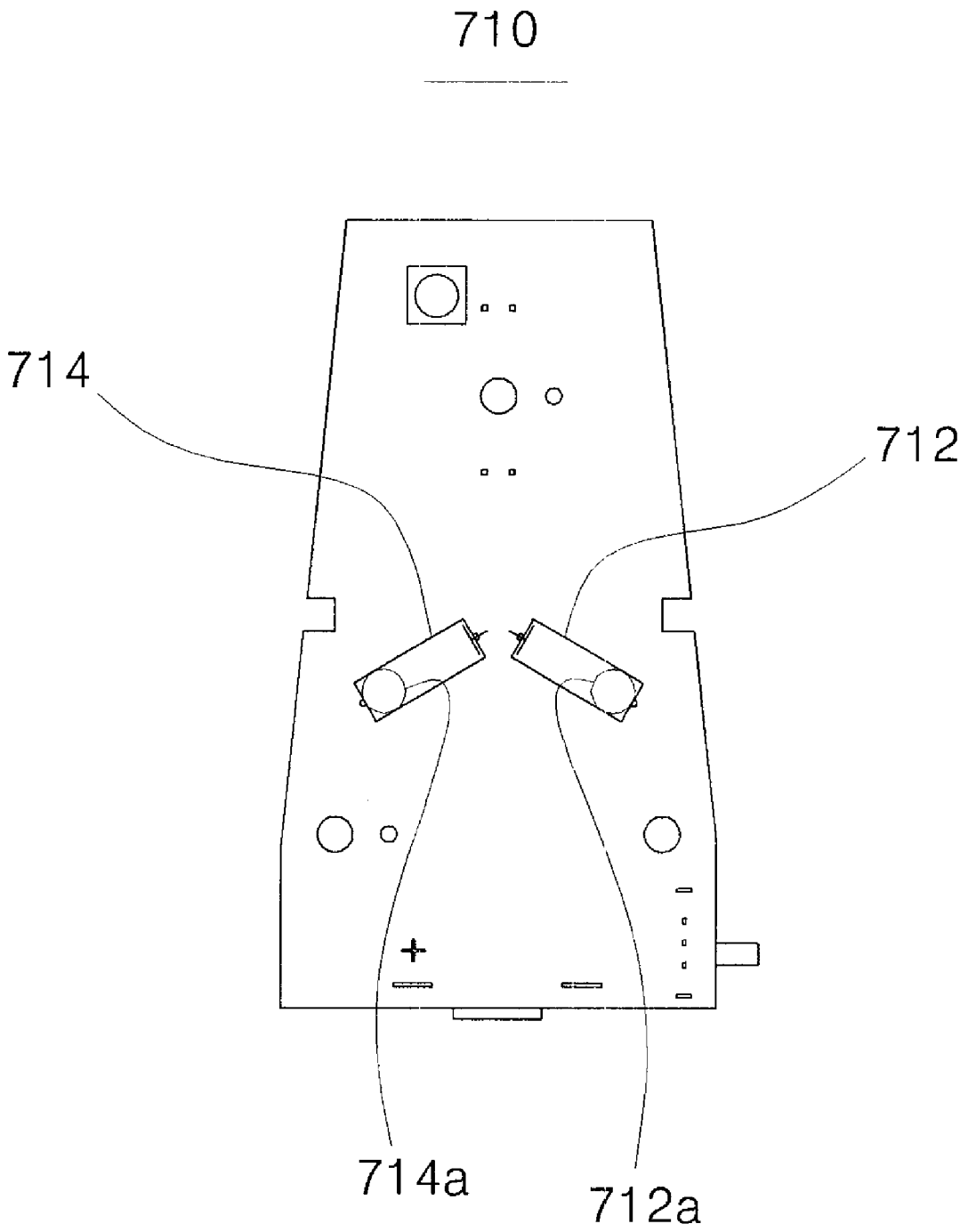
FIG. 13 is a plan view showing a tilt sensing means, which is provided in the remote controller of the ornithopter capable of flying forward in an upright position according to the embodiment of the present invention.

As shown in FIG. 13, each tilt switch 712, 714 includes a movable member 712*a*, 7124*a*, which is moved in the tilt switch body to a first end or a second end of the tilt switch body by gravity depending on the angle at which the remote controller 700 is tilted.

Figure 14:
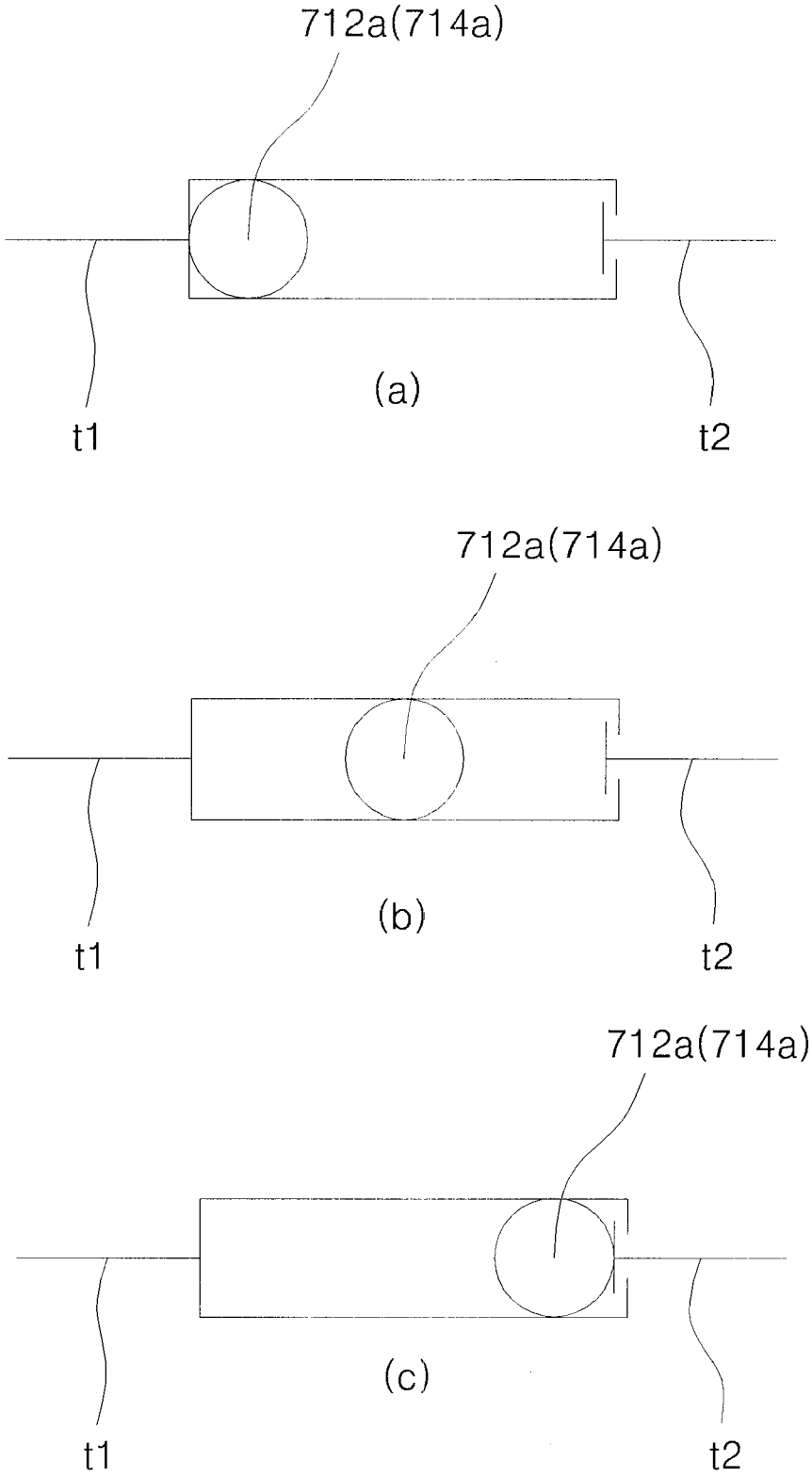
FIG. 14 is views illustrating the principle of a tilt switch, which is provided in the tilt sensing means of the remote controller of the ornithopter capable of flying forward in an upright position according to the embodiment of the present invention.

FIG. 14 illustrates the principle of the tilt switch 712, 714.

Each tilt switch includes a cylindrical body, which forms the entire external appearance of the tilt switch, a first leg t1, which is electrically connected to the cylindrical body, a second leg t2, which is electrically disconnected from the cylindrical body, and the movable member 712*a*, 714*a*, which is a conductor, is grounded to the cylindrical body, and is movable in the cylindrical body.

As shown in FIGS. 14(*a*) and 14(*b*), when the movable member 712*a*, 714*a* is disconnected from the second leg t2, which is electrically disconnected from the cylindrical body, the tilt switch is in an OFF state. In this state, electric current cannot flow between the first leg t1 and the second leg t2.

As shown in FIG. 14(*c*), when the movable member 712*a*, 714*a* is connected to the second leg t2, which is electrically disconnected from the cylindrical body, the tilt switch enters an ON state. In this state, electric current flows between the first leg t1 and the second leg t2.

In the case where the tilt switches using the above-mentioned principle are disposed in the tilt sensing means 710 at appropriate angles, the left and right tilt switches can be turned ON/OFF merely by tilting the controller 700, thus easily generating a direction changing signal.

Figure 15:
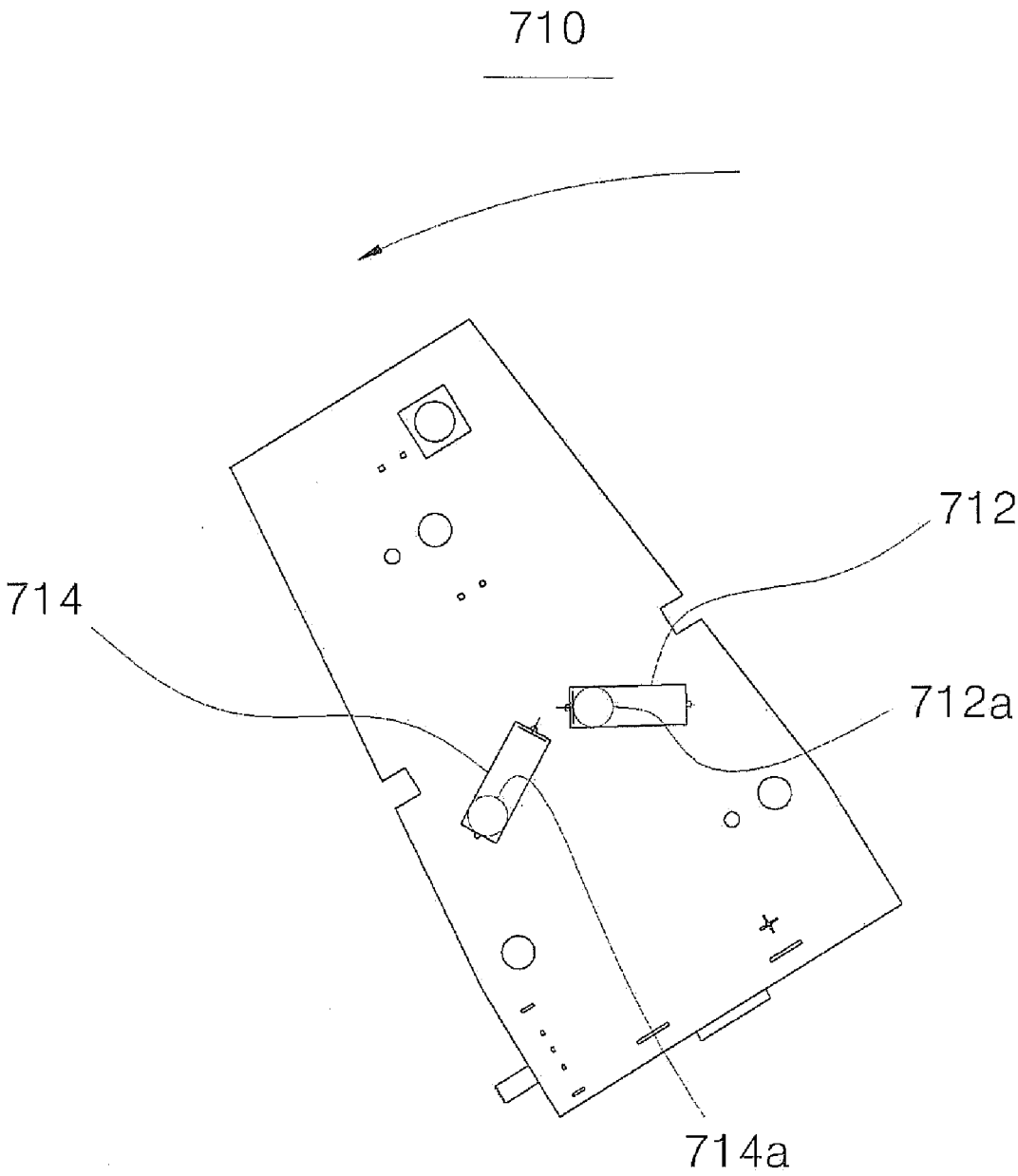
FIGS. 15 and 16 are views illustrating the control operation of the tilt sensing means of the remote controller of the ornithopter capable of flying forward in an upright position according to the embodiment of the present invention.

As one example, as shown in FIG. 15, when the remote controller 700 is tilted to the left, one tilt switch 712 enters the ON state, and the remaining tilt switch 714 enters the OFF state.

In this case, the remote controller creates a signal for controlling the direction control motor 420 such that it is rotated in reverse so that the direction in which the remote-controlled ornithopter flies changes to the left. Here, this control signal is transmitted to the receiver 610 of the flight control unit 600 through the transmitter 722 of the manipulation control part 720.

Figure 16:
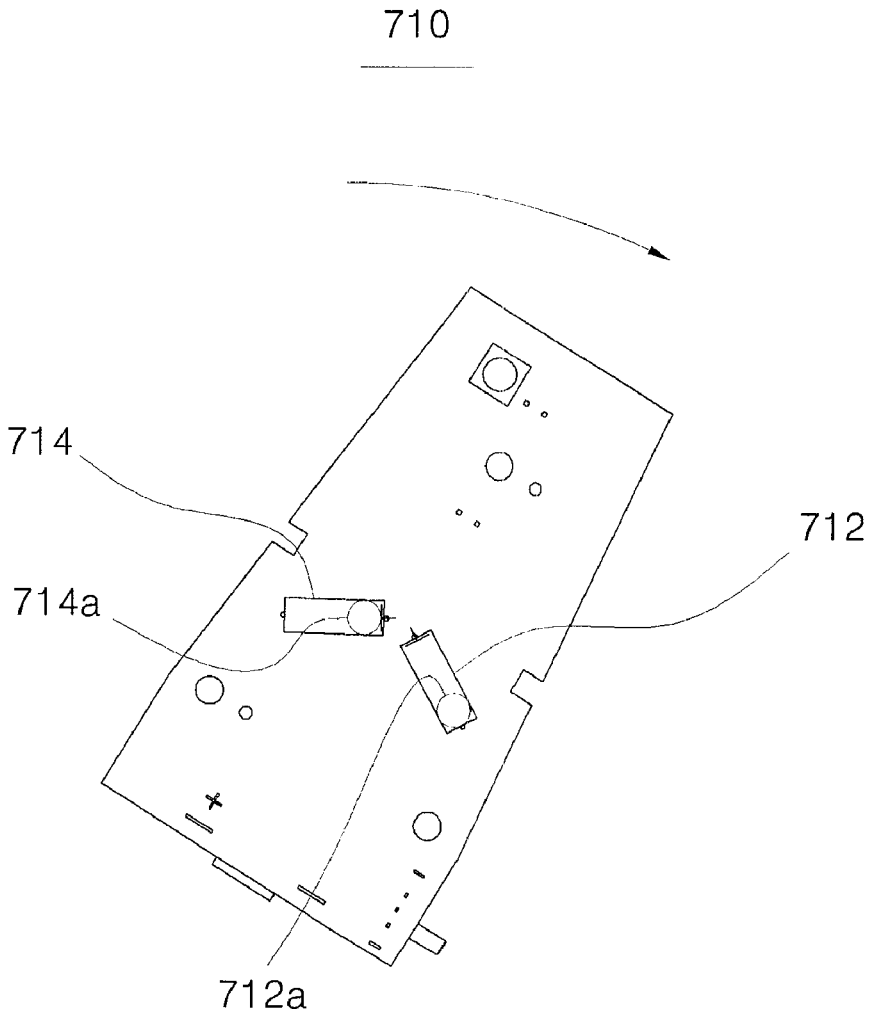

In contrast, as shown in FIG. 16, when the remote controller 700 is tilted to the right, the tilt switch 712 enters the OFF state, and the tilt switch 714 enters the ON state.

In this case, the remote controller creates a control signal for controlling the direction control motor 420 such that it is rotated in a forward direction, so that the direction in which the remote-controlled ornithopter flies is changed to the right. Of course, this control signal is transmitted to the receiver 610 of the flight control unit 600 through the transmitter 722 of the manipulation control part 720.

Meanwhile, the remote controller 700 further includes a red LED L1, which indicates that a battery is being charged, and a green LED L2, which indicates that the remote controller is in a turned-ON state.

Figure 17:
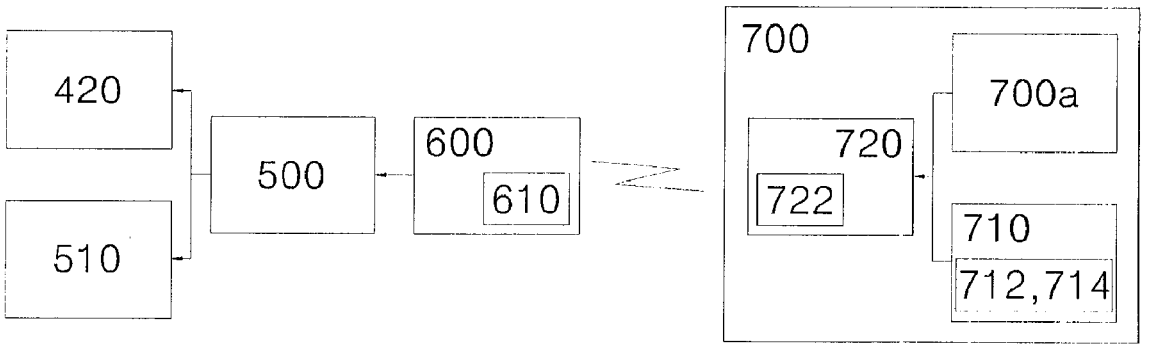
FIG. 17 is a schematic block diagram illustrating a process of remote-controlling the ornithopter capable of flying forward in an upright position according to the embodiment of the present invention.
Figure 18:
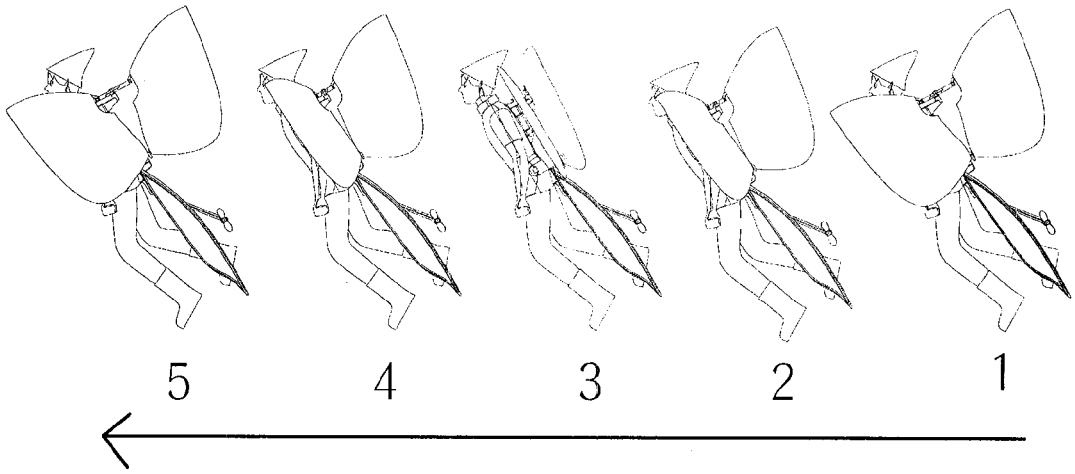
FIG. 18 is views showing forward flight of the remote-controlled ornithopter in an upright position according to the embodiment of the present invention.

FIG. 17 is a schematic block diagram illustrating a process of remote-controlling the ornithopter according to the embodiment of the present invention. FIG. 18 is views showing the forward flight of the remote-controlled ornithopter in the upright position according to the embodiment of the present invention.

INDUSTRIAL APPLICABILITY

As described above, compared to the conventional ornithopter having a pair of main wings, the remote-controlled ornithopter according to the present invention can increase aerodynamic lift and thrust and maintain moments generated in a fuselage constant, thus promoting stable flight. The present invention can be controlled by simple manipulation.

In addition, in the present invention, because the moments generated in the fuselage can be maintained constant, forward flight in the upright position, hovering flight and low-speed flight can be conducted stably. Therefore, the present invention can be used as an indoor toy by forming the fuselage in a fairy shape, and can be used as a reconnaissance device having a subminiature camera.

As well, because the present invention has X-shaped main wings having a simple construction, aerodynamic lift and thrust can be enhanced, compared to the conventional ornithopter having one pair of main wings.

Moreover, in the X-shaped main wings, each cam arm has a turning radius such that the angular range within which one pair of main wings of upper and lower main wings flapping is less than the angular range within which the main wings of the conventional ornithopter having one pair of main wings flapping. Therefore, the energy consumption of the present invention is less than or similar to that of the conventional ornithopter, thus having an energy-saving effect.

In the present invention, upper frames and lower frames are made of plastic, which is relatively inexpensive. Hence, it is easy to manufacture the main wings such that they have a relatively large area, and the production costs can be reduced. As well, the manufacturing process is simplified, so that the present invention can be easily adapted for mass production.

In a remote-control method of the present invention, unlike the conventional control method, the remote control can be conducted by tilting or rotating a remote controller, thus realizing a human interface technology.

Therefore, the present invention is implemented such that the user conducts remote control using reflexive motion, thus making it easy to learn the remote-control method, and attracting interest in the remote-control toy.

Furthermore, the remote controller has a simple structure using a pair of tilt switches, without requiring a sensor or a separate mechanical manipulation device. Accordingly, there are advantages in that the cost of materials is reduced and productivity is increased.

In addition, each of the main frames and the subsidiary frames has a shape such that the cross-sectional area thereof is reduced from the proximal end to the distal end, thus increasing the flexibility. Therefore, air flow can be effectively guided around the distal ends of the main frames and the subsidiary frames, thus enhancing the thrust of the ornithopter.

As well, in the present invention, X-shaped arms have bent ends such that, when the ends of the X-shaped arms are closest to each other, the upper frames and the lower frames are parallel to each other. Therefore, the flow rate achieved by flapping of the main wings can be increased, and the air flow can be efficiently concentrated in the correct direction.

The invention claimed is:

1. A remote-controlled ornithopter capable of flying forward in an upright position, comprising:

a fuselage;

X-shaped main wings provided on an upper surface of a front end of the fuselage;

tail wings provided on an upper surface of a medial portion or an upper surface of a rear end of the fuselage;

a tail rotor for controlling a direction in which the fuselage flies;

a drive unit for operating the main wings; and a flight control unit, having a receiver to receive a control signal for controlling the drive unit and the tail rotor, so that operation of the drive unit and the tail rotor is controlled depending on the control signal transmitted to the receiver.

2. The remote-controlled ornithopter capable of flying forward in an upright position according to claim 1, wherein the main wings comprise:

X-shaped arms crossing each other to have an "X" shape, the X-shaped arms being coupled to each other at a central portion thereof so as to be rotatable with respect to each other; two upper frames coupled to and extending from two respective upper ends of the X-shaped arms; an upper skin attached to the two upper frames; two lower frames coupled to two respective lower ends of the X-shaped arms; and a lower skin attached to the two lower frames.

3. The remote-controlled ornithopter capable of flying forward in an upright position according to claim 2, wherein the X-shaped arms are configured such that:

the two upper ends of the X-shaped arms are bent downwards and the two lower ends of the X-shaped arms are bent upwards, so that, when the two upper ends and the two corresponding lower ends are disposed adjacent to each other, the upper frames are parallel to the lower frames.

4. The remote-controlled ornithopter capable of flying forward in an upright position according to claim 2, wherein each of the upper frames and the lower frames is made of plastic, and comprises:

a main frame inserted into a corresponding end of the X-shaped arm; and a subsidiary frame extending from a portion of the main frame backwards, integrally, wherein each of the main frame and the subsidiary frame is reduced in a cross-sectional area towards an end thereof.

5. The remote-controlled ornithopter capable of flying forward in an upright position according to claim 2, wherein the drive unit comprises a gear power transmission unit for operating the main wings, the gear power transmission unit comprising: a drive motor to provide rotating force for flying the fuselage; a gear train to transmit the rotating force from the drive motor at reduced speed; two driven wheels engaging with respective opposite sides of a last gear of the gear train; two rotating cam arms extending outwards from center shafts of the two respective driven wheels; and two connecting rods coupling respective ends of the two rotating cam arms to the corresponding lower ends of the X-shaped arms, so that, when the rotating force is transmitted from the drive motor to the driven wheels through the gear train, the connecting rods swing the opposite ends of the X-shaped arms upwards and downwards around the central portion of the X-shaped arms.

6. The remote-controlled ornithopter capable of flying forward in an upright position according to claim 1, wherein the tail wings comprise:

tail wing frames extending from respective opposite sides of the upper surface of the medial portion or the upper surface of the rear end of the fuselage outwards and upwards at predetermined inclinations, each of the tail wing frames having a closed curve shape; and a tail wing skin attached to the tail wing frames.

7. The remote-controlled ornithopter capable of flying forward in an upright position according to claim 1, wherein the tail rotor comprises:

an extension rod extending towards a space above the tail wings; a direction control motor provided on an end of the extension rod, the direction control motor having a rotating shaft; and a propeller provided on the rotating shaft of the direction control motor.

8. The remote-controlled ornithopter capable of flying forward in an upright position according to claim 1, further comprising:

a remote controller to transmit the control signal for controlling the drive unit and the tail rotor.

9. The remote-controlled ornithopter capable of flying forward in an upright position according to claim 8, wherein the remote controller comprises:

a tilt sensing means for detecting a change in tilt relative to a direction of gravity; and a manipulation control part, having a transmitter to transmit the control signal, created depending on a change in tilt detected by the tilt sensing means, to the receiver of the flight control unit.

10. The remote-controlled ornithopter capable of flying forward in an upright position according to claim 9, wherein the tilt sensing means comprises:

a pair of tilt switches inclined at predetermined angles relative to a horizontal plane and provided to have a symmetrical structure, wherein:

each of the tilt switches comprises a movable member to be moved in the tilt switch to a first end or a second end of the tilt switch by a gravity depending on an angle at which the remote controller is tilted, wherein, when the movable member is brought into contact with the first end in the tilt switch, the tilt switch is turned ON, and, when the movable member is brought into contact with the second end in the tilt switch, the tilt switch is turned OFF.

11. The remote-controlled ornithopter capable of flying forward in an upright position according to claim 10, wherein the pair of tilt switches is constructed such that, when the remote controller is tilted to a left, one tilt switch, which is disposed at a first position, is turned ON, and a remaining tilt switch, which is disposed at a second position, is turned OFF, so that the remote-controlled ornithopter flies to the left, and, when the remote controller is tilted to a right, the tilt switch, which is disposed at the first position, is turned OFF, and the tilt switch, which is disposed at the second position, is turned ON, so that the remote-controlled ornithopter flies to the right.

* * * * *